US005820339A

United States Patent [19]

Trojahn

[11] Patent Number: 5,820,339

[45] Date of Patent: Oct. 13, 1998

[54] TURBINE WHEEL FOR DRIVE TURBINE ESPECIALLY OF METAL WORKING MACHINERY

[75] Inventor: Hans-Werner Trojahn, Bergisch Gladbach, Germany

[73] Assignee: Joisten & Kettenbaum GmbH & Co. KG, Bergisch Gladbach, Germany

[21] Appl. No.: 773,621

[22] Filed: Dec. 20, 1996

[30] Foreign Application Priority Data

Dec. 28, 1995 [DE] Germany ..... 295 22 650 U

[51] Int. Cl.[6] ..... F10D 1/02

[52] U.S. Cl. ..... 415/202

[58] Field of Search ..... 415/92, 185, 202, 415/208.2, 208.3, 211.2, 904; 416/90, 92, 235; 60/39.44

[56] References Cited

U.S. PATENT DOCUMENTS 634,270 10/1899 Patton ..... 415/904
2,663,541 12/1953 Geen ..... 415/185
3,804,549 4/1974 Kellenbarger ..... 415/185

FOREIGN PATENT DOCUMENTS 0159578 3/1911 Germany ..... 415/202
0143976 6/1920 United Kingdom ..... 415/202

*Primary Examiner*—Christopher Verdier
*Attorney, Agent, or Firm*—Harness, Dickey & Pierce, P.L.C.

[57] ABSTRACT

A turbine wheel for drive turbines especially of metal working machinery consisting of a disc-shaped wheel body (1) with a central bearing opening (2) and intake orifices (4) concentrically located on the circumference of a lateral disc surface (3) and of drive air channels (5) running inside the wheel body each ending in an outlet orifice (14). The outlet orifices (14) are located on the peripheral disc surface (7) where the drive air channels (5) show an inflow section (6) of approximately axial direction and an outflow section (8) running inside the disc body (1) in the direction to the peripheral disc surface (7).

10 Claims, 3 Drawing Sheets

TURBINE WHEEL FOR DRIVE TURBINE ESPECIALLY OF METAL WORKING MACHINERY

BACKGROUND AND SUMMARY OF THE INVENTION

The present invention is that of a turbine wheel for drive turbines especially of metal working machinery consisting of a disc-shaped wheel body with a central bearing opening and intake orifices concentrically located on the circumference of a lateral disc surface and of drive air channels running inside the wheel body each ending in an outlet orifice.

Such turbine wheels are known. With them, the outlet orifices of the drive air channels are positioned in the lateral disc surfaces of the wheel body opposite the intake orifices. In addition, these conventional turbine wheels contain in their peripheral surfaces pocket-like cavities forming the engagement surface of the turbine wheel for the inflowing deceleration air. The efficiency of these conventional turbine wheels begins to decrease at 70–75% of the final rotational speed of the turbine wheels.

The present invention is based on the task to improve upon a turbine wheel described before to the effect that the efficiency, especially at high speeds, in the range of the final rotational speed is improved.

According to the invention this is achieved by the placement of the outlet orifices on the peripheral disc surface where the drive air channels show an inflow section of an approximately axial direction and a discharge section in the disc body running in the direction toward the peripheral disc surface. Thus, the invention achieves an essentially axially flowing inflow and an approximately radially flowing outflow of the compressed drive air. The radial outflow allows here for a substantial effective normal component being available through a large angle of rotation. In addition, the channeling of the drive air—according to the invention—causes a better air evacuation since the radial force components generated by the impact of the compressed drive air are reinforced through the centrifugal force thus improving air evacuation. Effective air evacuation of the drive air channels is important since, in case of a compressed air barrier, no new compressed drive air can stream into the drive air channels. Because of the design of the drive air channels according to the invention, the reversal of the same within the wheel body from the approximately axially directed inflow to the outflow in direction of the wheel body periphery can be optimized in such a measure that a substantial normal force component and, in addition, fast air evacuation are achieved.

Advantageous realizations of the invention are contained in the consequential claims. The design sample shown in the enclosed drawings explains the invention in more detail. Shown are:

DETAILED DESCRIPTION OF THE PREFERRED EMBODIMENT

Figure 1:
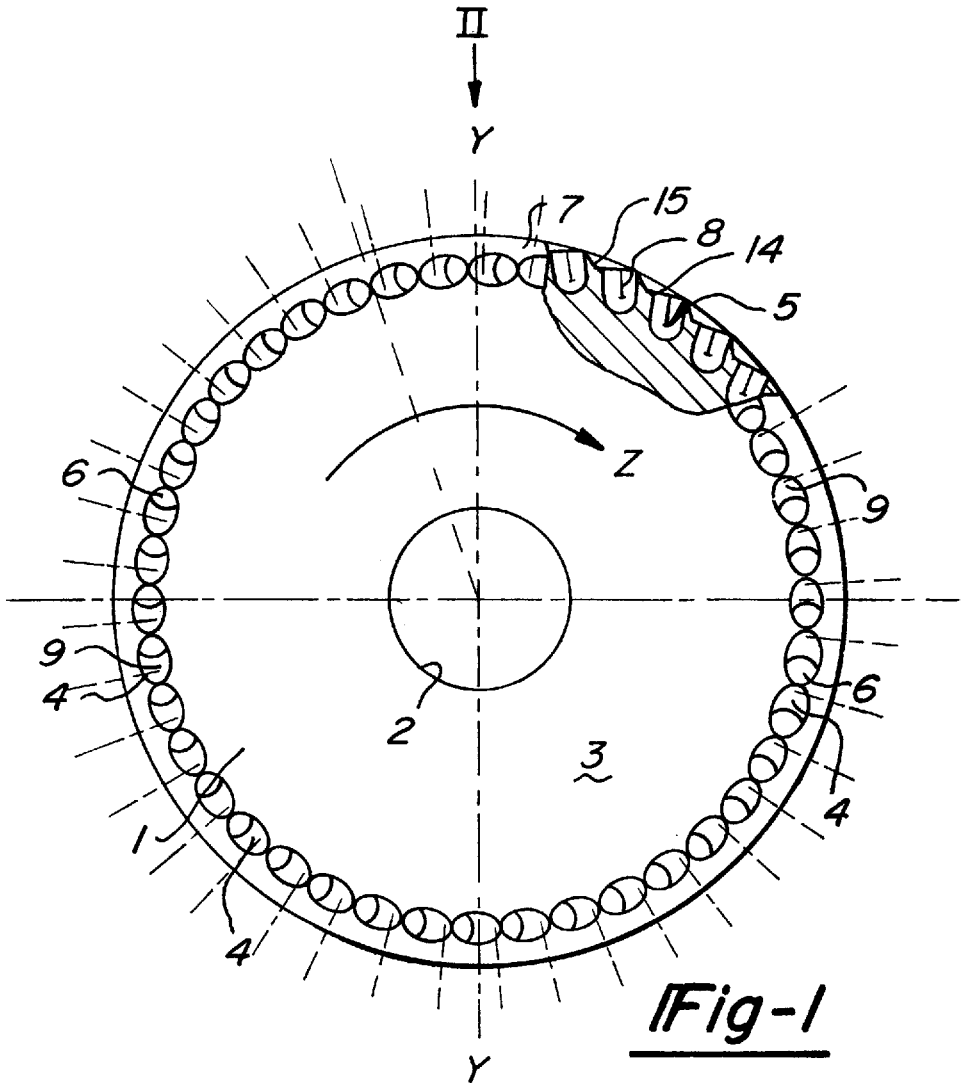
FIG. 1 a lateral view of the turbine wheel according to the invention, with partial sectional views, FIG. 2 a plan view onto the turbine wheel according FIG. 1, FIG. 3 a partial view of a turbine wheel, according to the invention, with partial cut-aways, together with inflow and deceleration jets and FIG. 4. a view according arrow IV in FIG. 3.
Figure 3:
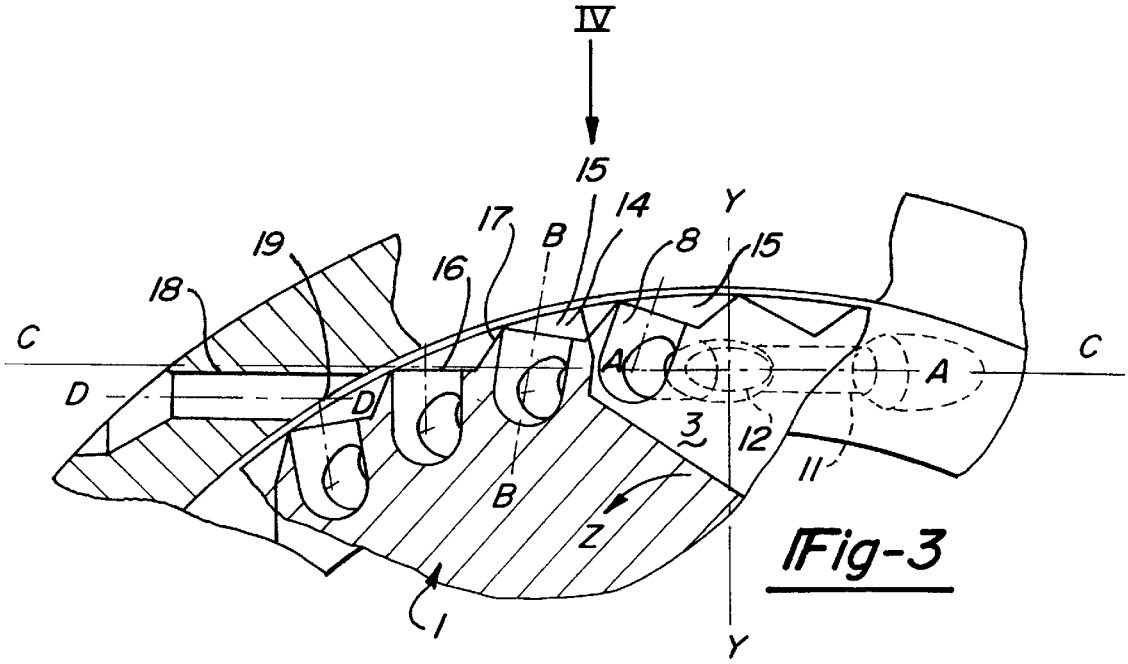
Figure 4:
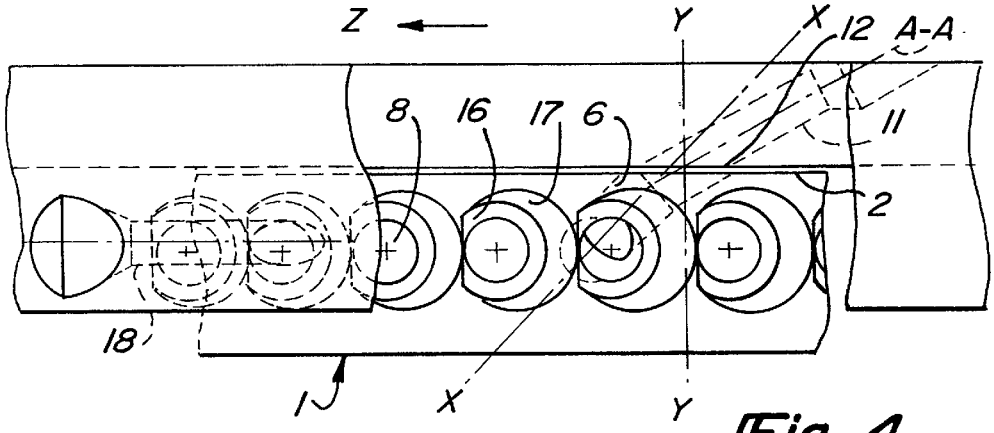

As resulting from FIG. 1, a turbine wheel according to the invention consists of a disc-shaped wheel body 1. Such a turbine wheel, has, e.g., a diameter of approximately 25–100 mm [1–4 in.] and a thickness of, e.g., 6–10 mm [0.24–0.40 in.]. The wheel body 1 has a central bearing opening 2 allowing it to be mounted, e.g., on a shaft not shown here. Concentrically to the bearing opening 2, intake orifices 4 of drive air channels 5 are located on the outer periphery of a lateral disc surface 3. The design sample shown has intake orifices 4 spaced approximately 9° apart on the periphery of the lateral disc surface 3. The drive air channels 5 contain an inflow section 6 running approximately in axial direction and an outflow section 8 running within the disc body in the direction toward the peripheral disc surface 7. The intake orifices 4 emerge in a bucket-shaped cavity 9 in the lateral disc surface 3 from the bottom of which the inflow section 6 of the respective drive air channel 5 penetrates into the wheel body 1. In the advantageous design sample shown, the intake orifices 4 have the shape of an ellipse. As can be seen especially from FIG. 4, the longitudinal axis X—X of each respective inflow section 6 of the drive channel 5 runs at an acute angle to the radial central plane Y—Y extending through the center point of the elliptical intake orifice 4. The longitudinal axis X—X lies in a transverse plane C—C which is perpendicular to the radial central plane Y—Y as shown in FIG. 3. The longitudinal axis X—X of the inflow section 6 runs here through the forward focal point—seen in the drive direction—of the elliptical intake orifice 4. Because of this configuration in conjunction with the elliptical intake orifice 4, the inflow of the drive air is effective through a greater angle of rotation. In addition, the invention provides that a discharge jet 11 for the drive air located laterally at the wheel body 1 is positioned in such a manner and has a discharge orifice 12 designed in such a fashion that the discharge orifice 12 in the maximum injection position runs coaxially with the intake orifice 4, see FIG. 4, when these two orifices coincide, where the discharge orifice 12 of the discharge jet 11 is smaller/equal to intake orifice 4. The longitudinal axis A—A of the discharge jet 11, see FIG. 4, runs obliquely to the lateral disk surface 3 preferably at an acute angle smaller than 45°. The intake orifices are shaped in such a fashion that their longer half-axis runs in the transverse plane C—C which is perpendicular to the radial central plane and their shorter half-axis runs in the radial central plane.

Figure 2:
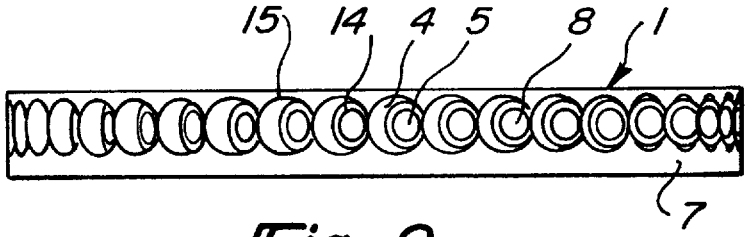

As can be seen especially from FIG. 1 and 2, the outflow sections 8 of the drive air channels 5 show outflow orifices 14 positioned on the peripheral surface 7 preferably in the deceleration pockets 15 formed there. The longitudinal axis B—B of the respective outflow section 8 of the drive air channels 5 runs at an acute angle obliquely to the radial central plane Y—Y opposite to the rotational drive direction Z.

Thus, as a result of the invention, an outflow of the drive air is achieved, which is behind (lags) in relationship to the rotational movement of the wheel body 1 whereby the evacuation of the drive air channels 5 and, at the same time, the drive component becomes effective when the drive air is discharged. The deceleration pockets 15 have a bottom plane 16 running perpendicular to the longitudinal axis B—B of the outflow section, the plane containing the respective outlet orifice 14 and a rebound parallel surface 17 running at an angle of greater than 90° and smaller than 180° to the bottom plane 16. These deceleration pockets 15 work together with a deceleration air jet 18 positioned on the periphery of the wheel body 1 in such a fashion, that the outlet orifice 19 of the deceleration jet 18 is adapted to the peripheral contour of the wheel body 1. The deceleration air jet 18 is here arranged in relationship to the wheel body 1 in such a way that its longitudinal axis D—D in the position in which outlet orifice 19 coincides with the opening of the deceleration pockets 15 form an obtuse angle with the rebound surface 17. The shape of the rebound surface 17 according to the design of the invention may be such in regard to size, shape or angle of incidence, that an optimal deceleration efficiency ratio may be achieved.

Figure 5:
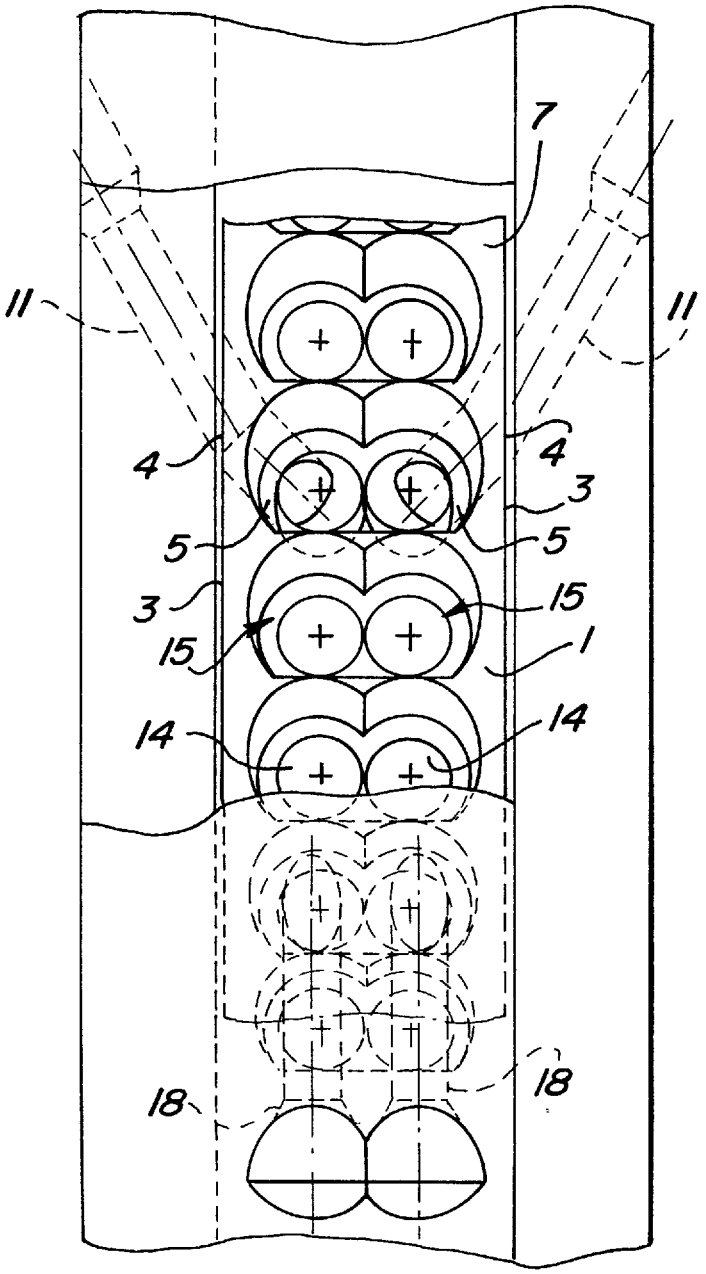
FIG. 5. a view according FIG. 4 of a further design of a turbine wheel according to the invention.

FIG. 5 shows a so-called duplex version of a turbine wheel according to the invention. The reference numbers for identical parts are the same as in FIG. 1 through 4. This turbine wheel has a two-sided compressed air admission by way of the discharge jets 11 positioned on both sides and blowing into the intake orifices 4 of separate drive air channels 5. In addition, two deceleration air jets 18 are positioned on the periphery of the wheel body 1 allowing them to blow into the deceleration pockets 15. Because of the two-sided pressure admission of the turbine wheel, a performance increase by a factor of approximately 2 is achieved, however, the required total installation space increases by approximately only 60%. Because of the two separate drive and deceleration avenues, the possibilities of performance variation have been considerably improved compared to a single drive and deceleration airway.

The present invention is not limited to the design sample shown, but encompasses all versions operating on the same principles as the invention. For instance, a different division of the intake orifices on the periphery of the turbine wheel is possible.

It is to be understood that the invention is not limited to the exact construction illustrated and described above, but that various changes and modifications may be made without departing from the spirit and scope of the invention as defined in the following claims.

We claim:

1. A turbine wheel for drive turbines comprising a disc-shaped wheel body (1) with a central bearing opening (2) and intake orifices (4) concentrically located on the circumference of a lateral disc surface (3) and of drive air channels (5) running inside the wheel body each ending in an outlet orifice (14) characterized by the fact that the outlet orifices (14) are located on the peripheral disc surface (7), where the drive air channels (5) each show an inflow section (6) of approximately an axial direction and an outflow section (8) running inside the disc body (1) in a direction to the peripheral disc surface (7), each intake orifice (4) being shaped like an ellipse whose small half-axis lies in a radial central plane (Y—Y) and whose large half-axis lies perpendicular to the radial central plane (Y—Y).

2. The turbine wheel according to claim 1, characterized by the fact that a longitudinal axis (X—X) of each inflow section (6) runs at an acute angle to a radial central plane (Y—Y) which extends through the center of each respective intake orifice (4), the axis (X—X) further lying in a transverse plane which is perpendicular to the radial central plane (Y—Y).

3. The turbine wheel according to claim 1 characterized by the fact that a longitudinal axis (B—B) of each outflow section (8) runs at an acute angle obliquely to the radial central plane (Y—Y) opposite to a rotational drive direction (Z).

4. The turbine wheel according to claim 1 characterized by the fact that the outlet orifices (14) are each located in a respective brake pocket (15) in the peripheral disc surface (7).

5. The turbine wheel according to claim 4, characterized by the fact that the brake pockets (15) each show a respective bottom plane (16) running vertically with respect to a longitudinal axis (B—B) of each respective outflow section (8) and containing both the respective outlet orifice (14) and a respective rebound surface (17) lying at an angle larger than 90 ° and smaller than 180° to it.

6. The turbine wheel according to claim 1 characterized by the fact that a discharge jet (11) for drive air is positioned on the side of the intake orifices (4) where an orifice (12) of the discharge jet is designed in such a fashion that the jet orifice (12) coincides in a co-axial manner in an optimal injection position with the individual intake orifices (4) with its shape adapted to that of each intake orifice (4).

7. The turbine wheel according to claim 4 characterized by the fact that a deceleration air jet (18) for discharge of deceleration air is positioned in the peripheral area of the wheel body (1) where an orifice (19) of the jet (18) is of a shape that is adapted to the peripheral contour of the wheel body (1) and to the size of the brake pockets (15).

8. The turbine wheel according to claim 1 characterized by the fact that a longitudinal axis (X—X) of each inflow section (6) of the drive air channels (5) runs through the respective forward focal point, viewed in a rotational drive direction (Z) of the wheel body (1), of the respective elliptical intake orifice (4).

9. The turbine wheel according to claim 1 characterized by the fact that the wheel body shows intake orifices (4) on its two lateral disc surfaces (3) with drive air channels (5) assigned to each intake orifice and entering into a respective one of the outlet orifices (14) in the peripheral disc surface (7).

10. The turbine wheel according to claim 9, characterized by the fact that one discharge jet (11) each is positioned on each lateral disc surface and two deceleration air jets (18) are positioned in the peripheral area.

* * * * *